US005893175A

United States Patent [19]

Cooper

[11] Patent Number: 5,893,175

[45] Date of Patent: Apr. 13, 1999

[54] PNEUMATIC TORSO ARMOR AND HELMET

[76] Inventor: Eric Cooper, 59 Bruce Park Dr., Trenton, N.J. 08618

[21] Appl. No.: 09/031,471

[22] Filed: Feb. 26, 1998

[51] Int. Cl.[6] ..... A41D 13/00

[52] U.S. Cl. ..... 2/462; 2/463; 2/DIG. 3

[58] Field of Search ..... 2/69, DIG. 3, DIG. 10, 2/425, 115, 102, 108, 459, 461, 462, 463, 467, 455, 456, 413; 441/88, 102, 103, 106, 107, 108, 111, 113–119, 121, 122

[56] References Cited

U.S. PATENT DOCUMENTS

| | | | |
|---|---|---|---|
| 745,007 | 11/1903 | Gamble | 2/DIG. 3 |
| 876,237 | 1/1908 | Ridlon | 2/DIG. 3 |
| 2,247,961 | 7/1941 | Mulvey | 2/DIG. 3 |
| 3,186,004 | 6/1965 | Carlini | 2/3 |
| 3,761,959 | 10/1973 | Dunning | 2/3 R |
| 3,866,241 | 2/1975 | Grant | 2/2 |
| 4,425,667 | 1/1984 | Harrison | 2/102 |
| 4,547,919 | 10/1985 | Wang | 2/413 |
| 5,263,203 | 11/1993 | Kraemer et al. | 2/413 |
| 5,720,051 | 2/1998 | Johnson | 2/413 |

*Primary Examiner*—Michael A. Neas
*Assistant Examiner*—Tejash D. Patel

[57] ABSTRACT

A new pneumatic torso armor and helmet for creating a visual display on a wearer for use at sporting events. The inventive device includes an inflatable body portion comprised of a front panel, a back panel, and a pair of shoulder panels. The front panel has a chest portion and an abdominal portion. A side of the front panel has an inflation tube extending outwardly therefrom. The front panel has couplers extending outwardly of lower side edges thereof. The back panel has corresponding couplers extending outwardly of lower side edges thereof for mating with the straps of the front panel. The shoulder panels have opposed lateral edges each having corresponding couplers disposed thereon for engaging the shoulder panels to a wearer.

1 Claim, 2 Drawing Sheets

PNEUMATIC TORSO ARMOR AND HELMET

BACKGROUND OF THE INVENTION

1. Field of the Invention

The present invention relates to protective garments and more particularly pertains to a new pneumatic torso armor and helmet for creating a visual display on a wearer for use at sporting events.

2. Description of the Prior Art

The use of protective garments is known in the prior art. More specifically, protective garments heretofore devised and utilized are known to consist basically of familiar, expected and obvious structural configurations, notwithstanding the myriad of designs encompassed by the crowded prior art which have been developed for the fulfillment of countless objectives and requirements.

Known prior art protective garments include U.S. Pat. No. 3,965,486 to Lightbody; U.S. Pat. No. 4,870,706 to Ketcham et al.; U.S. Pat. No. Des. 298,474 to Twede; U.S. Pat. No. 4,310,927 to DeBose; U.S. Pat. No. 5,303,425 to Mele; and U.S. Pat. No. 5,037,341 to Howard.

While these devices fulfill their respective, particular objectives and requirements, the aforementioned patents do not disclose a new pneumatic torso armor and helmet. The inventive device includes an inflatable body portion comprised of a front panel, a back panel, and a pair of shoulder panels. The front panel has a chest portion and an abdominal portion. A side of the front panel has an inflation tube extending outwardly therefrom. The front panel has couplers extending outwardly of lower side edges thereof. The back panel has corresponding couplers extending outwardly of lower side edges thereof for mating with the straps of the front panel. The shoulder panels have opposed lateral edges each having corresponding couplers disposed thereon for engaging the shoulder panels to a wearer.

In these respects, the pneumatic torso armor and helmet according to the present invention substantially departs from the conventional concepts and designs of the prior art, and in so doing provides an apparatus primarily developed for the purpose of creating a visual display on a wearer for use at sporting events.

SUMMARY OF THE INVENTION

In view of the foregoing disadvantages inherent in the known types of protective garments now present in the prior art, the present invention provides a new pneumatic torso armor and helmet construction wherein the same can be utilized for creating a visual display on a wearer for use at sporting events.

The general purpose of the present invention, which will be described subsequently in greater detail, is to provide a new pneumatic torso armor and helmet apparatus and method which has many of the advantages of the protective garments mentioned heretofore and many novel features that result in a new pneumatic torso armor and helmet which is not anticipated, rendered obvious, suggested, or even implied by any of the prior art protective garments, either alone or in any combination thereof.

To attain this, the present invention generally comprises an inflatable body portion comprised of a front panel, a back panel, and a pair of shoulder panels. The front panel has a chest portion and an abdominal portion. A side of the front panel has an inflation tube extending outwardly therefrom. The front panel has a pair of hook and loop straps extending outwardly of lower side edges thereof. The back panel has corresponding hook and loop straps extending outwardly of lower side edges thereof for mating with the hook and loop straps of the front panel. The shoulder panels have opposed lateral edges each having corresponding hook and loop straps disposed thereon for engaging the shoulder panels to a wearer. An inflatable helmet portion is provided that is dimensioned for being worn on a head of a wearer. The helmet portion has a main head portion and a face guard portion. The helmet portion has an inflation tube extending outwardly of a rear portion thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pneumatic torso armor and helmet apparatus and method which has many of the advantages of the protective garments mentioned heretofore and many novel features that result in a new pneumatic torso armor and helmet which is not anticipated, rendered obvious, suggested, or even implied by any of the prior art protective garments, either alone or in any combination thereof.

It is another object of the present invention to provide a new pneumatic torso armor and helmet which may be easily and efficiently manufactured and marketed.

It is a further object of the present invention to provide a new pneumatic torso armor and helmet which is of a durable and reliable construction.

An even further object of the present invention is to provide a new pneumatic torso armor and helmet which is susceptible of a low cost of manufacture with regard to both materials and labor, and which accordingly is then susceptible of low prices of sale to the consuming public, thereby making such pneumatic torso armor and helmet economically available to the buying public.

Still yet another object of the present invention is to provide a new pneumatic torso armor and helmet which provides in the apparatuses and methods of the prior art some of the advantages thereof, while simultaneously overcoming some of the disadvantages normally associated therewith.

Still another object of the present invention is to provide a new pneumatic torso armor and helmet for creating a visual display on a wearer for use at sporting events.

Yet another object of the present invention is to provide a new pneumatic torso armor and helmet which includes an inflatable body portion comprised of a front panel, a back panel, and a pair of shoulder panels. The front panel has a chest portion and an abdominal portion. A side of the front panel has an inflation tube extending outwardly therefrom. The front panel has couplers extending outwardly of lower side edges thereof. The back panel has corresponding couplers extending outwardly of lower side edges thereof for mating with the straps of the front panel. The shoulder panels have opposed lateral edges each having corresponding couplers disposed thereon for engaging the shoulder panels to a wearer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
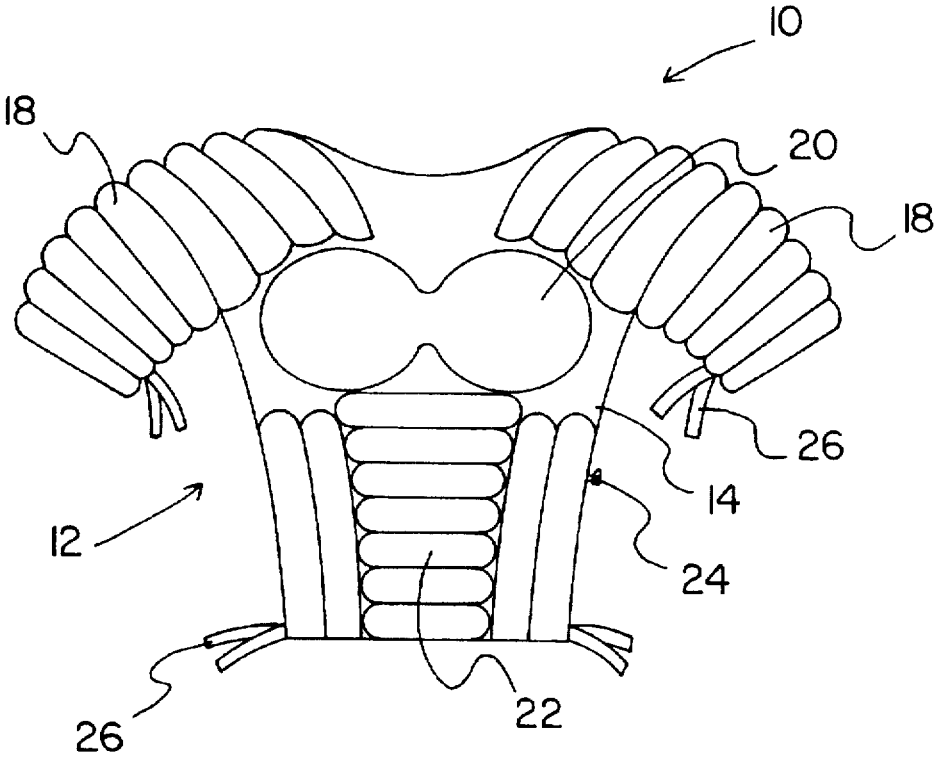
FIG. 1 is a front view of a new pneumatic torso armor according to the present invention.
Figure 2:
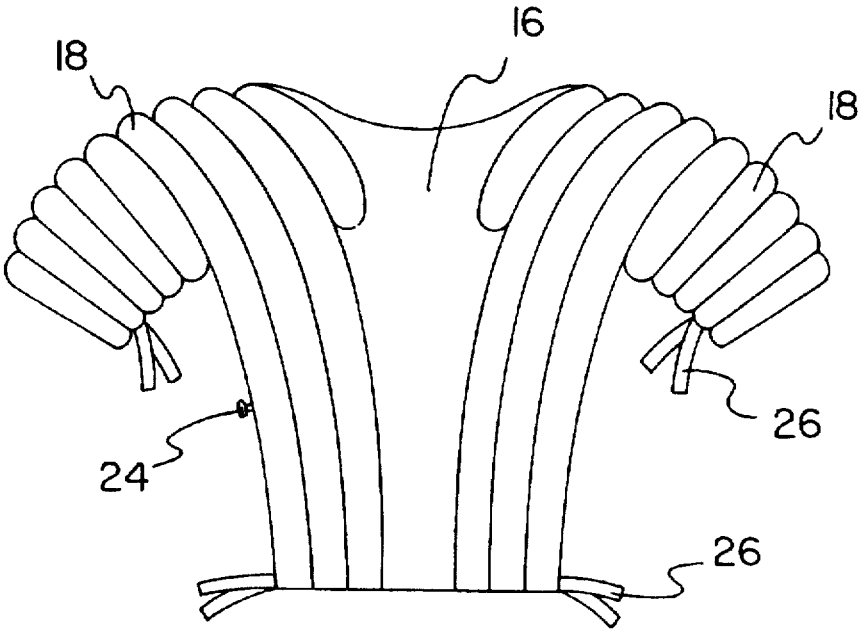
FIG. 2 is a rear view of the torso armor of the present invention.
Figure 3:
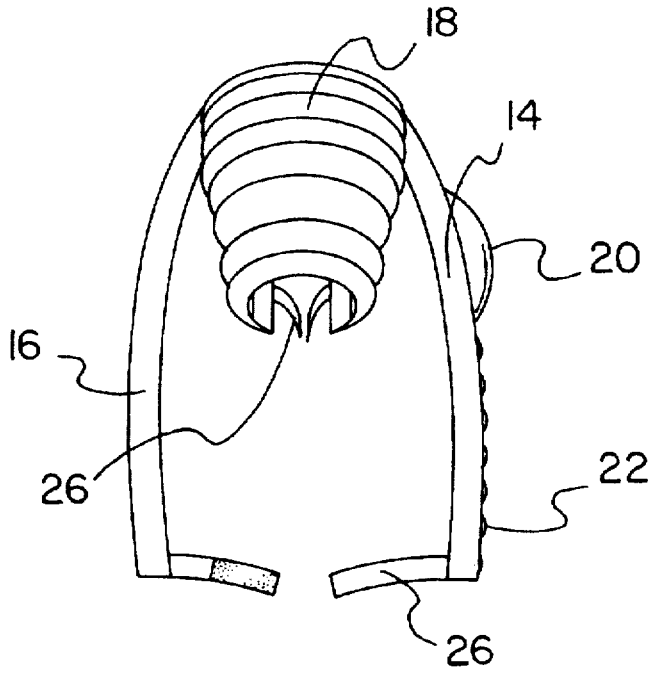
FIG. 3 is a side view of the torso armor of the present invention.
Figure 4:
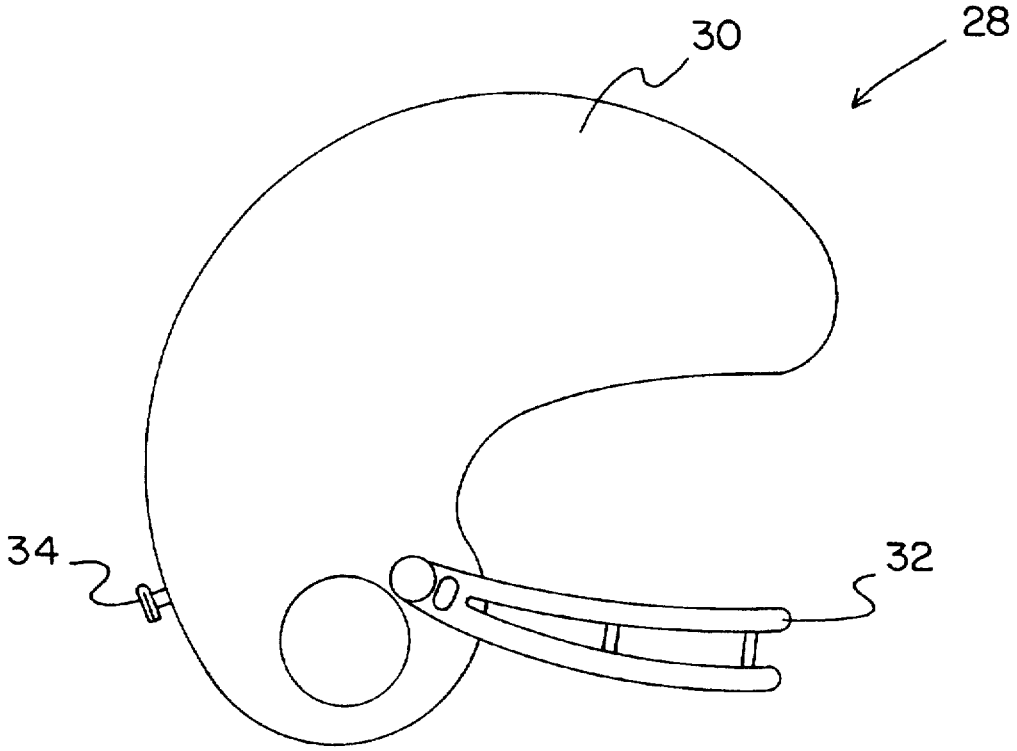
FIG. 4 is a side view of the helmet of the present invention.

With reference now to the drawings, and in particular to FIGS. 1 through 4 thereof, a new pneumatic torso armor and helmet embodying the principles and concepts of the present invention and generally designated by the reference numeral will be described.

As best illustrated in FIGS. 1 through 4, the pneumatic torso armor and helmet 10 comprises an inflatable body portion 12 comprised of a front panel 14, a back panel 16, and a pair of shoulder panels 18. The front panel 14 has a chest portion 20 and an abdominal portion 22. A side of the front panel 14 has an inflation tube 24 extending outwardly therefrom. The front panel 14 has a pair of hook and loop straps 26 extending outwardly of lower side edges thereof. The back panel 16 has corresponding hook and loop straps 26 extending outwardly of lower side edges thereof for mating with the hook and loop straps 26 of the front panel 14. The shoulder panels 18 have opposed lateral edges each having corresponding hook and loop straps 26 disposed thereon for engaging the shoulder panels 18 to a wearer.

An inflatable helmet portion 28 is provided that is dimensioned for being worn on a head of a wearer. The helmet portion 28 has a main head portion 30 and a face guard portion 32. The helmet portion 28 has an inflation tube 34 extending outwardly of a rear portion thereof.

In use, the helmet portion 28 could be produced to resemble the head gear of any sport. The body portion 12 would have a short-sleeved vest appearance, and would attach to the user's body by means of the straps 26. The inflation tubes 24,34 both can be filled by the mouth of the user. The user would simply put the body portion 12 and the helmet portion on to simulate a player. An alternate use of the present invention, allows children to use the body portion 12 and the helmet portion 28 as protection during physical activity.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pneumatic torso armor and helmet for creating a visual display on a wearer for use at sporting events comprising, in combination:

an inflatable body portion comprised of a front panel, a back panel having a pair of side portions each defined by abutting vertically oriented linear parts which extend along an entire height thereof, and a pair of shoulder panels each defined by a plurality of coaxially aligned abutting semicircular portions a fraction of which are integrally coupled with the vertically oriented linear parts of the back panel, wherein diameters of the semicircular portions decrease from top to bottom, the front panel including a pair of free side edges and having a chest portion defined by a pair of laterally offset circular parts and an abdominal portion defined by a central extent formed of a plurality of abutting horizontally oriented linear parts positioned beneath the chest portion and equipped with lengths which decrease from top to bottom with the central extent being flanked by a two pair of abutting vertically oriented linear parts which extend along an entire height of the central extent, one of the side edges of the front panel having an inflation tube extending outwardly therefrom at a central extent thereof, the front panel having a pair of hook and loop straps extending outwardly of lower ends of the side edges thereof, the back panel having corresponding hook and loop straps extending outwardly of lower ends of side edges thereof for mating with the hook and loop straps of the front panel, the shoulder panels having opposed lateral edges each having corresponding hook and loop straps disposed thereon for engaging the shoulder panels to a wearer; and an inflatable helmet portion dimensioned for being worn of a head of a wearer, the helmet portion having a main head portion and a face guard portion, the helmet portion having an inflation tube extending outwardly of a rear portion thereof.

* * * * *